US005739733A

United States Patent [19]

Cameron

[11] Patent Number: 5,739,733

[45] Date of Patent: Apr. 14, 1998

[54] DISPERSION COMPENSATION TECHNIQUE AND APPARATUS FOR MICROWAVE FILTERS

[75] Inventor: Richard J. Cameron, High Wycombe, England

[73] Assignee: Com Dev Ltd., Cambridge, Canada

[21] Appl. No.: 624,212

[22] Filed: Mar. 29, 1996

[30] Foreign Application Priority Data

Apr. 3, 1995 [GB] United Kingdom ..... 9506866

[51] Int. Cl.[6] ..... H01P 1/208

[52] U.S. Cl. ..... 333/202; 333/212

[58] Field of Search ..... 333/28 R, 202, 333/202 DR, 208, 209, 212

[56] References Cited

U.S. PATENT DOCUMENTS

| | | | |
|---|---|---|---|
| 4,216,448 | 8/1980 | Kasuga et al. | 333/212 X |
| 4,360,793 | 11/1982 | Rhodes et al. | 333/212 |
| 4,453,146 | 6/1984 | Fiedziuszko | 333/212 |
| 4,477,785 | 10/1984 | Atia | 333/202 |
| 4,622,523 | 11/1986 | Tang | 333/28 R |
| 4,652,843 | 3/1987 | Tang et al. | 333/212 |
| 4,686,496 | 8/1987 | Syrett et al. | 333/202 |
| 5,200,721 | 4/1993 | Mansour | 333/212 |
| 5,493,258 | 2/1996 | Parker | 333/212 X |

FOREIGN PATENT DOCUMENTS

| | | | |
|---|---|---|---|
| 0101369 | 2/1984 | European Pat. Off. | 333/212 |

OTHER PUBLICATIONS

Kurzrok; "Amplitude Equalizer is Circulator Coupled"; *Microwaves*; Sep., 1971; pp. 50–52.

Kudsia et al.; "Innovations in Microwave Filters and Multiplexing Networks for Communications Satellite Systems"; *IEEE Transactions on Microwave Theory and Techniques*, vol. 40, No. 6; Jun., 1992; pp. 1133–1149.

*Primary Examiner*—Robert Pascal
*Assistant Examiner*—Barbara Summons
*Attorney, Agent, or Firm*—Daryl W. Schnurr

[57] ABSTRACT

A microwave filter has a plurality of resonant cavities with each cavity containing a dielectric resonator. There are self-equalizing probes or self-equalizing apertures located between some of the cavities. A circulator is connected to an output of the filter. The circulator has an input/output which is connected to an equalizer. The equalizer contains a dielectric resonator that is slightly different from the dielectric resonators of the filter to permit the equalizer to be tuned at a slightly different frequency from the filter. The equalizer and self-equalizing probes or apertures are capable of being operated to reduce a dispersive slope of the filter. The filter can operate in a single mode or a dual mode. The electrical performance of the filter is superior to prior art filters, particularly in the wideband versions because the dispersive slope is reduced.

27 Claims, 9 Drawing Sheets

DISPERSION COMPENSATION TECHNIQUE AND APPARATUS FOR MICROWAVE FILTERS

BACKGROUND OF THE INVENTION

1. Field of the Invention

This invention relates to self-equalized and external-equalized microwave filters and to a method of operation thereof. More particularly, this invention relates to a filter and method of operation thereof whereby a dispersive slope of an output of the filter is reduced.

2. Description of the Prior Art

Dielectric resonator filters are increasingly used within communication satellite repeater subsystems, serving as input demultiplexer (IMUX) filters for the high quality wideband channels that such satellites carry. The specifications for in-band amplitude and group delay linearity, and close-to-band noise and interference rejection, are typically very stringent for IMUX filters, and it is known that high performance waveguide filters satisfy the required specifications.

Previous filters have been configured for either external equalization (EE) or self-equalization (SE) of in-band group delay. External equalization means that a bandpass filter provides the rejection performance whilst separate circulator-coupled equalizer cavities, tuned to the same center frequency as the filter, compensate for the bandpass filters' in-band group delay non-linearities, resulting in a flat in-band group delay response overall. A self-equalized filter is provided with internal couplings between non-adjacent resonators, in addition to the main sequential-resonator couplings, which give the in-band linearity and high selectivity without the need for external equalizer cavities. In general, the EE filter configuration performs slightly better electrically than the SE equivalent, but is less compact, less temperature stable, and more complex to manufacture requiring more components and support provisions.

Although filters that are either externally-equalized or self-equalized perform well in general, a disadvantage is that they tend to be rather large and heavy, even when realized with dual-mode resonators (two electrical resonances in one physical cavity). However, with the advent of high performance dielectric materials, it has been possible to replace the pure waveguide resonator cavity with an equally performing dielectric loaded cavity, but which is much smaller in size and mass. The dielectric-loaded resonators may be intercoupled to form SE or EE filters as required in the same manner as the pure waveguide resonators. The result is not only a lighter and smaller filter giving a performance equivalent to that obtainable from a pure waveguide realization, but also a more convenient mechanical configuration (for close packing or stacking) and an inherently robust structure with fewer parts. Moreover, an automatic temperature compensation scheme may be implemented with dielectric filters, allowing their construction with aluminum instead of Invar as needed for the stabilization of waveguide filters.

It is known to have dielectric resonator filters at C- and Ku-bands, particularly self-equalized for IMUX applications. It is also known to use the single $TEH_{01}$ dielectric resonance mode because of its high unloaded Q-factor (Qu), ease of manufacture and flexibility amongst other reasons. These filters have been equal in performance to previously known waveguide filters, yet about 25–30% of the mass and about 20% of the volume of said previously known filters.

In-band slopes in the group delay performance of these dielectric filters has proved to be troublesome, particularly in the wideband versions. The group delay slopes are caused by a phenomenon known as dispersion, which is caused in the case of dielectrically loaded filters, by working closer to the cut-off frequency than with waveguide filters.

Dispersive group delay slopes may be countered by "offset tuning" or by the introduction of special asymmetric cross-coupling in SE filters at the prototype design stage to predistort the group delay characteristic in the opposite sense to the dispersive slope, thereby cancelling the slope. Although both of these methods have been used with some success, they are quite sensitive and tend to degrade filter performance somewhat in other areas.

SUMMARY OF THE INVENTION

With the present invention, a circulator and a single dielectric resonator mounted in an equalizer provide an improved method for the cancellation of dispersive group delay slopes in dielectric filters, avoiding the problems associated with previous methods. The filter has self-equalization and the equalizer is tuned to a similar but slightly different frequency than that of the filter. Preferably, the different frequency between the equalizer and the filter will be achieved by choosing the resonator in the equalizer to be a slightly different size than the resonator(s) of the filter. Alternatively, the equalizer and filter can be tuned differently by varying the depth of tuning screws in either or both the equalizer and the filter. Usually, the equalizer frequency will be slightly higher than the filter frequency. The equalizer has only one input coupling and becomes an "all reflect network" (i.e. all input power is reflected back out minus the small amount that is absorbed by the resonator itself through the non-infinite Q-factor). The signal reflected out of the cavity will be delayed relative to the input signal, typically varying with frequency as shown in FIG. 1. The centre frequency and shape of the group delay characteristic may be adjusted by altering the resonant frequency of the cavity and the strength of the input coupling.

A microwave filter has at least one cavity containing a dielectric resonator, said cavity having at least one of self-equalizing probes and self-equalizing apertures therein. The filter has an input and an output, said output of said filter being connected to an input of a circulator, said circulator having an input/output and an output. The input/output of said circulator is connected to an equalizer, said equalizer containing a dielectric resonator. The resonator of said equalizer is slightly different from the resonator or resonators in said filter to permit said equalizer to be tuned at a slightly different frequency from said filter. The equalizer and said self-equalizing probes are capable of being operated to reduce a dispersive slope of said filter.

A microwave filter has at least one cavity, said filter having a waveguide and having an input and an output operatively connected thereto. The output of said filter is connected to an input of a circulator, said circulator having an input/output and an output. The input/output of said circulator is connected to an equalizer. The filter contains extracted pole cavities, said extracted pole cavities being connected to said waveguide and being located between the input and output of said filter. Said extracted pole cavities creating transmission zeros in said filter. The equalizer having a different frequency than a frequency of said filter.

A method of reducing a dispersive slope of an output of a microwave filter, said filter having at least one cavity the dielectric resonator in said at least one cavity, said filter having self-equalizing probes therein, said filter having an input and an output, said output being connected to an input of a circulator, said circulator having an output and an input/output, said input/output of said circulator being connected to an equalizer, said equalizer containing a dielectric resonator, said method comprising tuning said filter to a particular frequency, adjusting said self-equalizing probes and tuning said equalizer to a slightly different frequency from said filter to reduce a dispersive slope of an output of said filter.

A method of reducing a dispersive slope of an output of a microwave filter, said filter having a waveguide and at least one cavity, said filter having an input and an output operatively connected thereto, said output of said filter being connected to an input of a circulator, said circulator having an output and an input/output, said input/output of said circulator being connected to an equalizer, said filter having extracted pole cavities therein, said method comprising tuning said filter to a slightly different frequency from a frequency of said equalizer, and using said extracted pole cavities to create transmission zeros within said filter.

DESCRIPTION OF A PREFERRED EMBODIMENT

Figure 1:
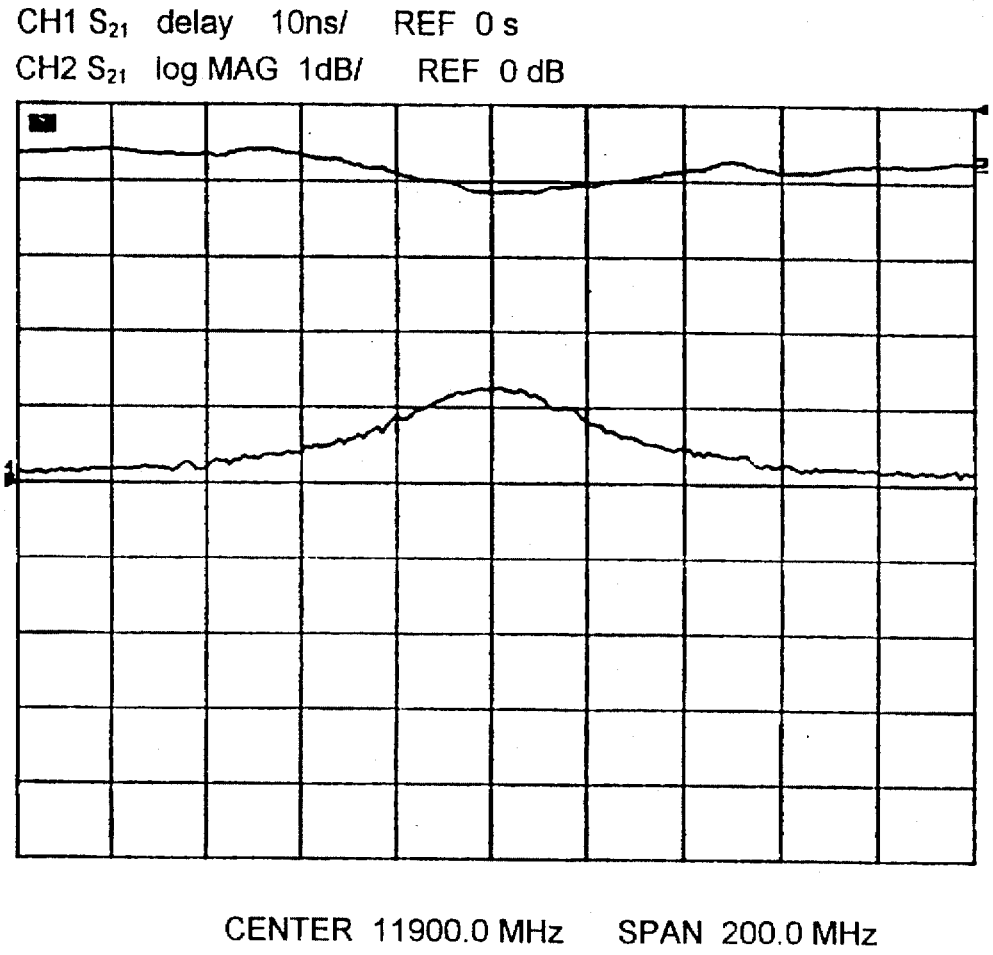
FIG. 1 is a graph of typical group delay and amplitude characteristics of a reflective equalizer cavity.
Figure 2A:
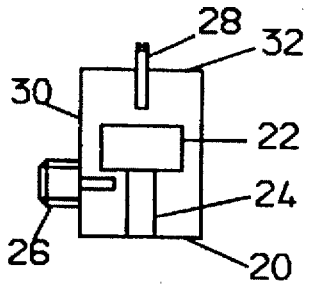
FIG. 2*a* is a schematic side view of an equalizer cavity in accordance with the present invention.

In FIG. 2*a*, an equalizer cavity 20 contains a dielectric resonator 22 mounted on a support 24. The equalizer cavity 20 has a coupling probe 26 and a tuning screw 28 penetrating walls 30, 32 respectively of the cavity 20.

Figure 2B:
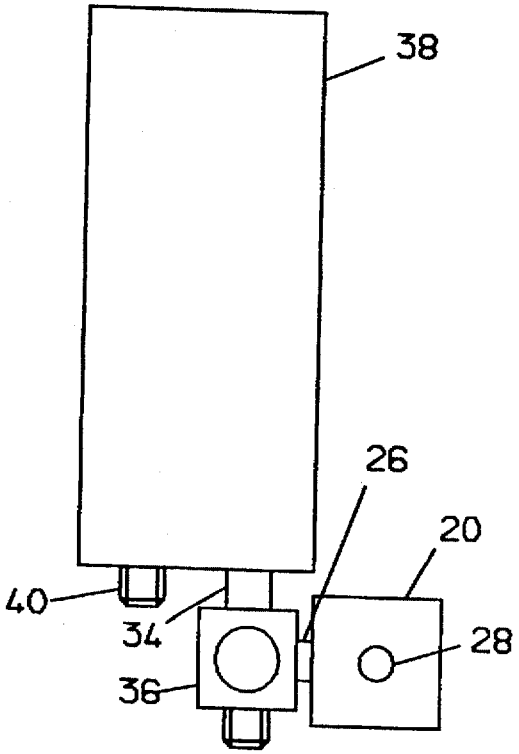
FIG. 2*b* is a schematic side view of a filter, circulator and equalizer.
Figure 3A:
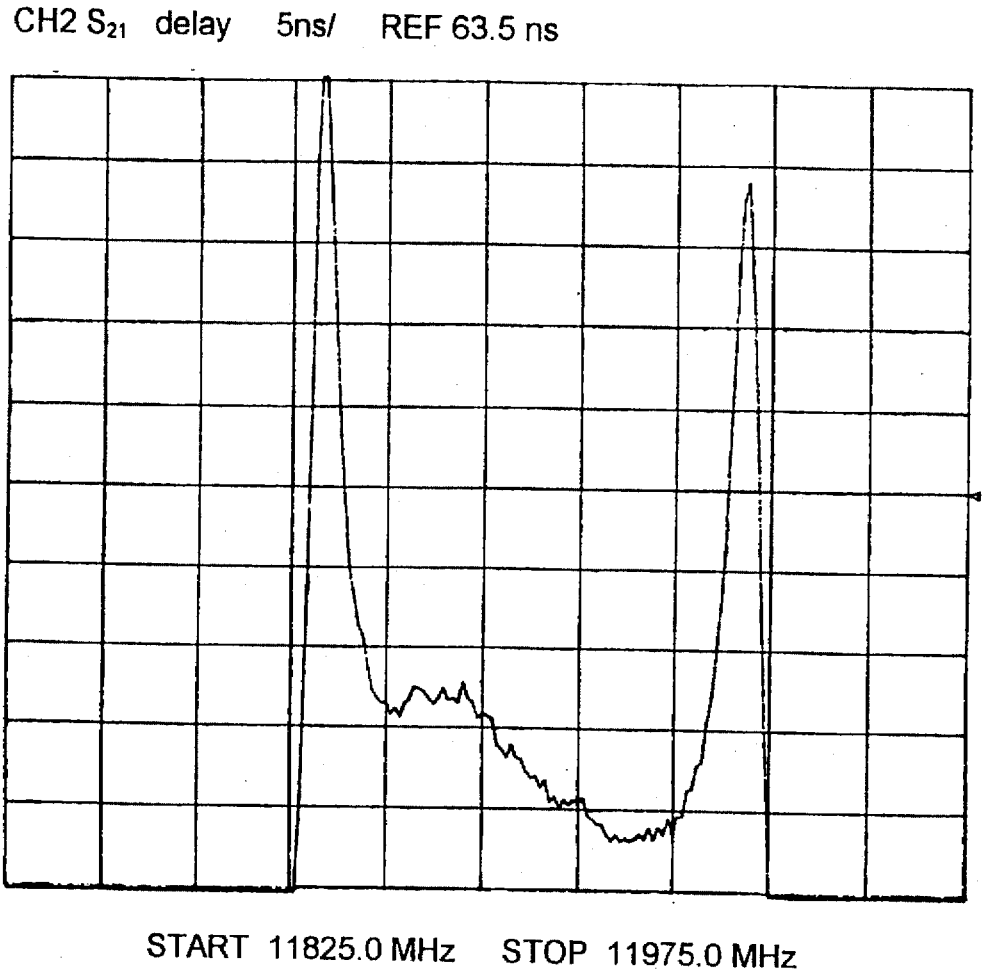
FIG. 3*a* is a graph showing the measured group delay characteristic of a Ku-band filter without dispersion equalization.
Figure 3B:
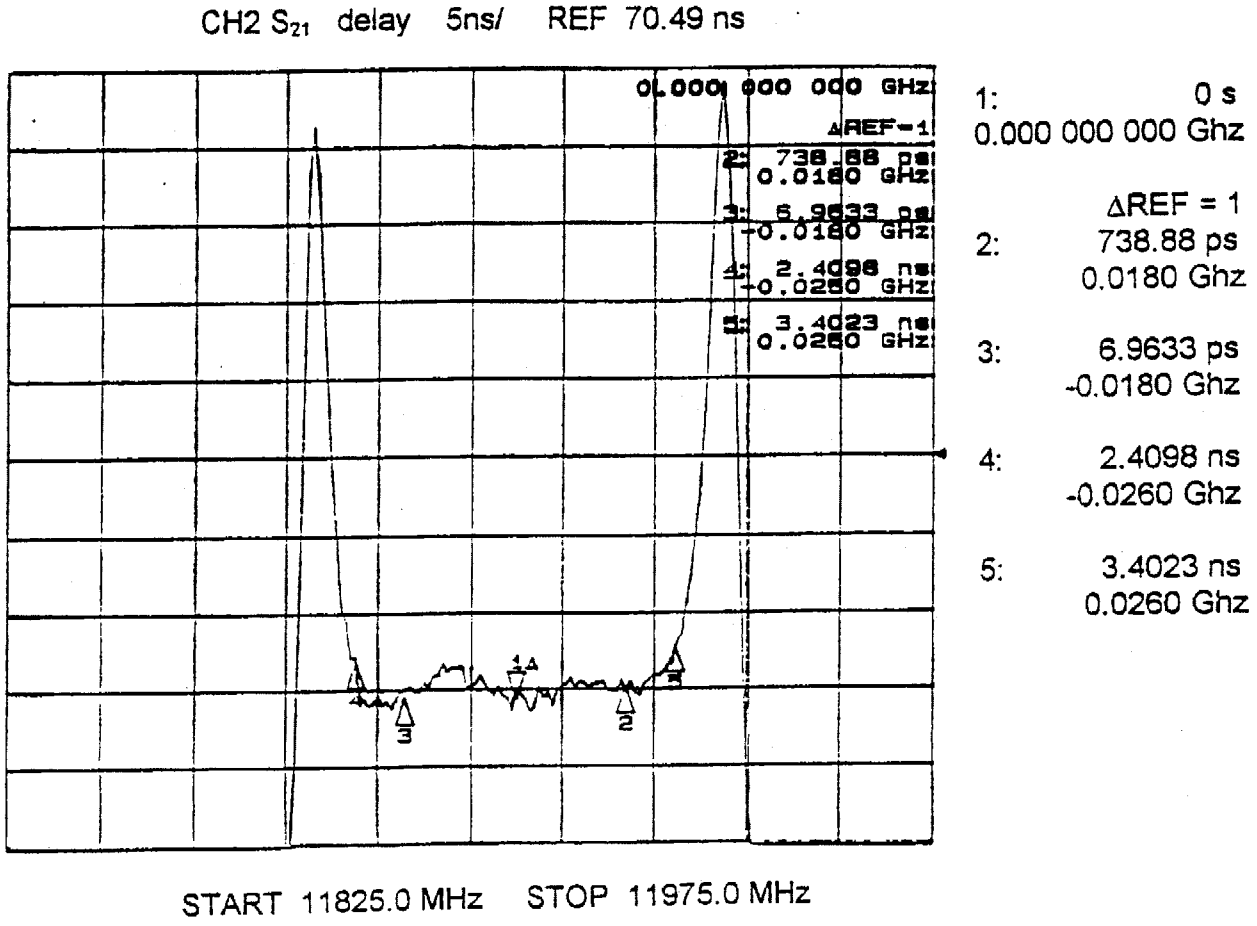
FIG. 3*b* is a graph of the measured group delay characteristic of a Ku-band filter with dispersion equalization.

When the equalizer cavity 20 is connected in series with a filter output 34 via a circulator 36 as shown in FIG. 2*b*, the amplitude and group delay responses of the equalizer 20 are effectively added directly to those of a filter 38. The filter 38 has an input 40. If the resonant frequency of the equalizer 20 is set to be above the passband of the filter, the group delay slope of the equalizer 20 will be positive over the usable bandwidth (henceforth "UBW") of the filter 38, and will tend to cancel the negative group delay slope over the UBW caused by dispersion in the filter's resonance cavities. By adjusting the equalizer center frequency and the strength of the coupling, the filter's dispersive group delay slope may be almost entirely cancelled. This is illustrated in FIGS. 3*a* and 3*b*, which show the measured group delay characteristic of a Ku-band self-equalized filter without and with the equalizer 20 respectively. Without the equalizer, the group delay shows a pronounced in-band group delay slope, which would be damaging to communications signals passing through the filter. With the equalizer adjusted correctly, the slope may be virtually eliminated, as shown in FIG. 3*b*. The equalizer adjustment process may be done very rapidly and, because of the circulator, does not affect the rejection or return loss performance of the filter. Being a relatively wideband device, it is insensitive to set-up accuracy and thermal variations.

Figure 4A:
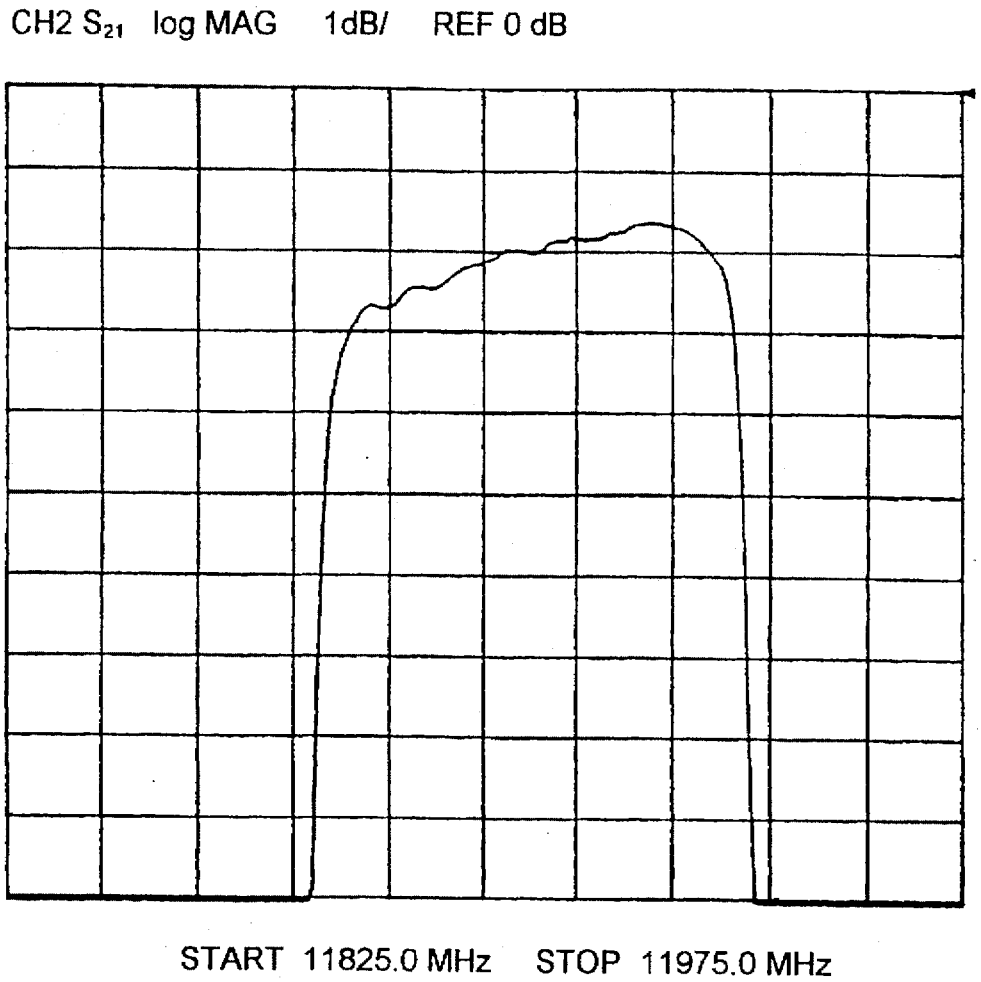
FIG. 4*a* is a measured in-band amplitude characteristic of a Ku-band filter without dispersion equalization.
Figure 4B:
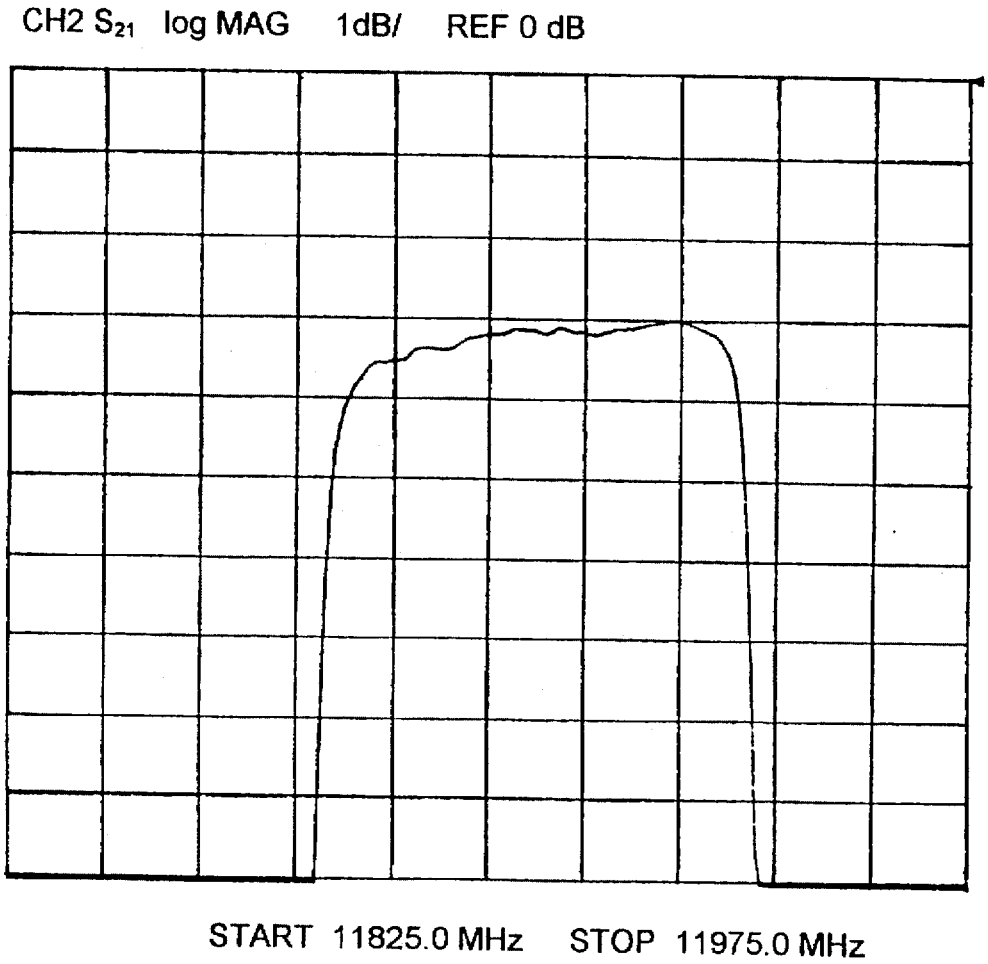
FIG. 4*b* is a measured in-band amplitude characteristic of a Ku-band filter with dispersion equalization.

A secondary benefit that derives from the external slope equalizer is in-band amplitude slope equalization. Dispersion in the presence of dissipative loss tends to produce a slope in the amplitude characteristic of a bandpass filter over its passband. In the same way that group delay slope is cancelled, the amplitude slope of the equalizer also tends to cancel the dispersion-induced amplitude slope of the filter. The equalizer's amplitude slope may be adjusted by introducing lossy elements within the cavity, e.g. an unplated steel screw 43 (see FIG. 2*a*). FIG. 4 shows the measured in-band amplitude performance of the same filter as in FIG. 3, with and without the equalizer respectively.

At Ku-band, the equalizer will add about 16 gm to the overall filter. The circulator will not constitute additional mass since it is normal to include an isolator at the output of an IMUX filter to match it into following cables, amplifiers, etc. The equalizer may be installed at the port on the circulator where a load is normally connected to form the isolator.

Figure 5:
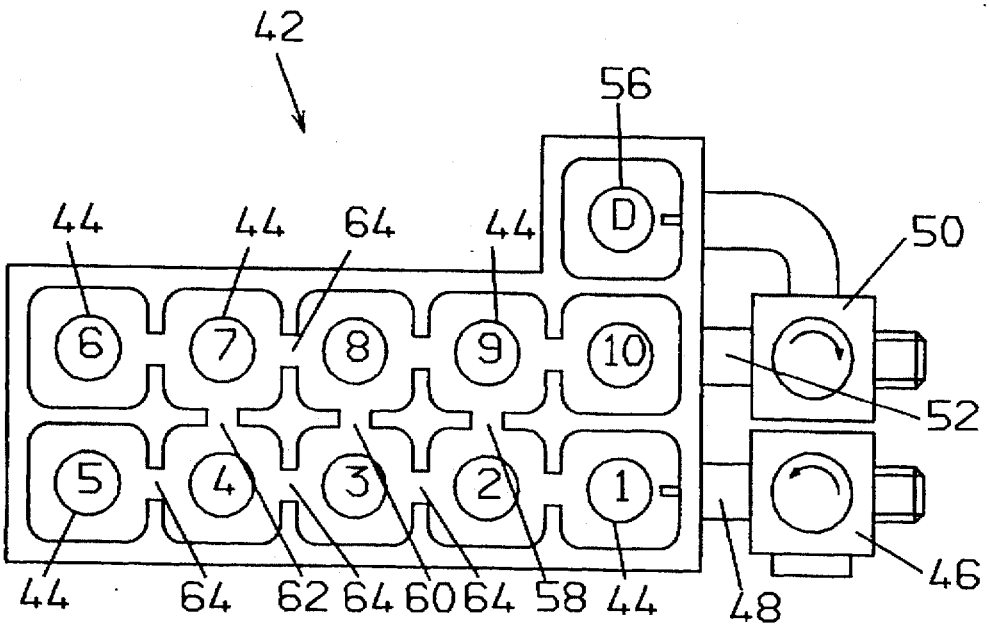
FIG. 5 is a dielectric resonator filter having a circulator and dispersion equalization cavity on a filter output.

In FIG. 5, a ten-pole planar single mode filter 42 has a dielectric resonator 44 in each cavity 1, 2, 3, 4, 5, 6, 7, 8, 9, 10. An isolator 46 is connected to a filter input. A circulator 50 and an equalization cavity D is connected to a filter output 52. The equalization cavity D contains a dielectric resonator 56 and functions as an equalizer. While the cavity D is built into the filter 42, it could be designed to be separate from the filter 42. Cross-coupling occurs between cavities 2 and 9, 3 and 8, as well as cavities 4 and 7 through cross-coupling apertures 58, 60, 62 respectively. The cavities 1 to 10 can be self-equalized by probes and/or apertures in a conventional manner. Sequential couplings occur through apertures 64 between cavities 1 and 2, 2 and 3, 3 and 4, 4 and 5, 5 and 6, 6 and 7, 7 and 8, 8 and 9, as well as, 9 and 10. Probes can be used for sequential couplings instead of apertures.

Figure 6:
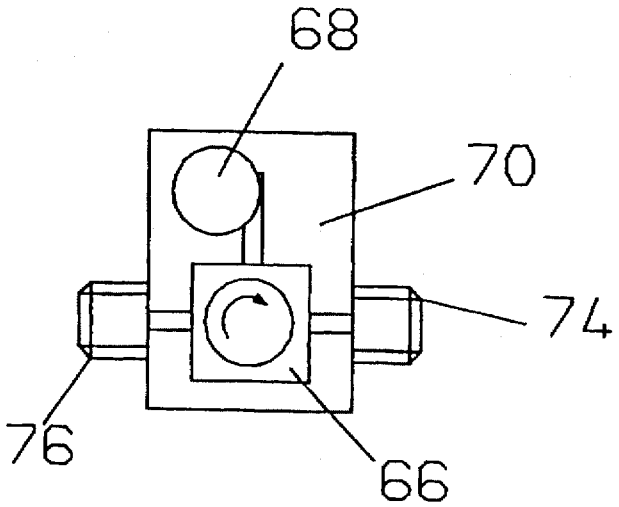
FIG. 6 is a schematic side view of a microstrip circulator and equalization cavity.

In FIG. 6, a drop-in circulator 66 and dielectric resonator 68 are imprinted onto a substrate 70 by microstrip 72. The circulator 66 has an input/output 74 and an input 76. This embodiment of the invention can be used on a filter output with microstrip or stripline filters.

Figure 7:
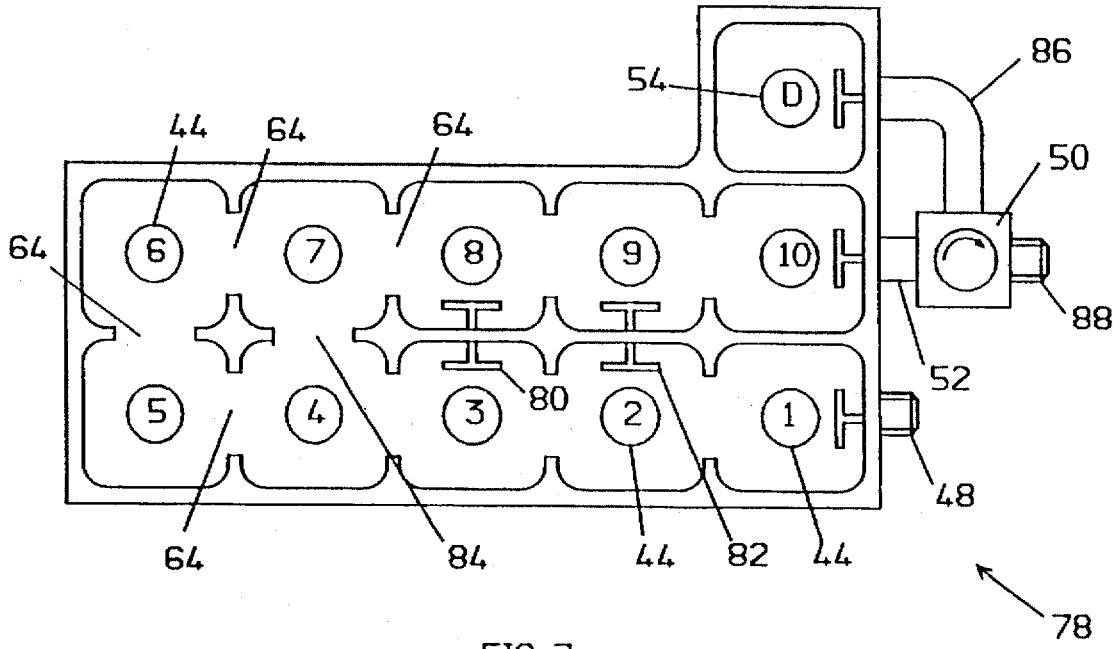
FIG. 7 is a side view of a coaxial filter where a filter output has a circulator and equalization cavity connected thereto.

In FIG. 7, a ten-pole coaxial filter 78 has ten cavities 1, 2, 3, 4, 5, 6, 7, 8, 9, 10 with each cavity containing a dielectric resonator 44. The same reference numerals are used as those used in FIG. 5 for those components that are the same. Self-equalization is accomplished by cross-couplings through probes 80, 82 between cavities 3 and 8 and 2 and 9 respectively and through an aperture 84 between cavities 4 and 7. Filter output 52 has a circulator 50 and dispersion equalization cavity D connected thereto. The cavity D functions as an equalizer and contains a dielectric resonator 54 as described for FIG. 5. The filter 78 has an input 48 and the circulator has an input/output 86 and an output 88.

Figure 8:
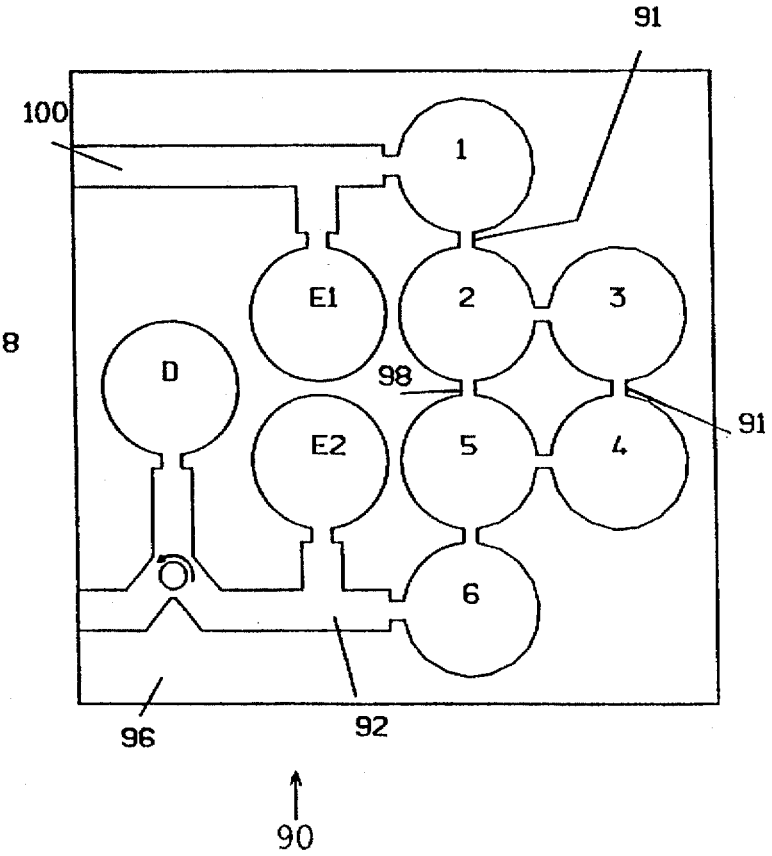
FIG. 8 is a waveguide filter with a circulator and equalization cavity connected to a filter output.

In FIG. 8, there is shown a waveguide extracted-pole self-equalized filter 90 having six cavities 1, 2, 3, 4, 5, 6. The cavities do not contain any dielectric resonators. Sequential couplings occur through apertures 91. The filter output 92 has a circulator 94 and dispersion equalization cavity D built-in to a filter housing 96. The dispersion equalization cavity D also does not contain a dielectric resonator. Self-equalization of the filter 90 is controlled by cross-coupling between cavities 2 and 5 through an aperture 98 between cavities 2 and 5. The filter 90 has an input 100 which is a rectangular waveguide like the output 92. Extracted pole cavity E1 is located between the input 100 and cavity 1. Extracted pole cavity E2 is located between cavity 6 and the dispersion equalization cavity D.

An extracted pole is a resonant cavity with a single coupling aperture and a short length of waveguide, connected via a "T" junction to the waveguide run leading up to the input or output of the main body of the filter. One filter may have a plurality of extracted pole cavities, which may be distributed arbitrarily between the input and output of the filter. The lengths of the waveguide between the input or the output aperture of the filter and the first extracted pole cavity and between the extracted pole cavities themselves, if there is more than one extracted pole cavity on the same waveguide run, are critical.

The extracted pole cavities introduce one transmission zero each to the transfer characteristics of the main body of the filter, without the need for cross-couplings within the main body of the filter. Sometimes, these cross-couplings may be impractical to implement. A design procedure is available to synthesize the equivalent electrical circuit of the main filter and its extracted pole cavities from a predetermined filter transfer function.

Coupling screws and tuning screws have been omitted from FIGS. 5 to 8 for ease of illustration. The location of the tuning and coupling screws is conventional and would be readily apparent to those skilled in the art. The filters shown in FIGS. 5 to 8 are single mode filters.

Figure 9:
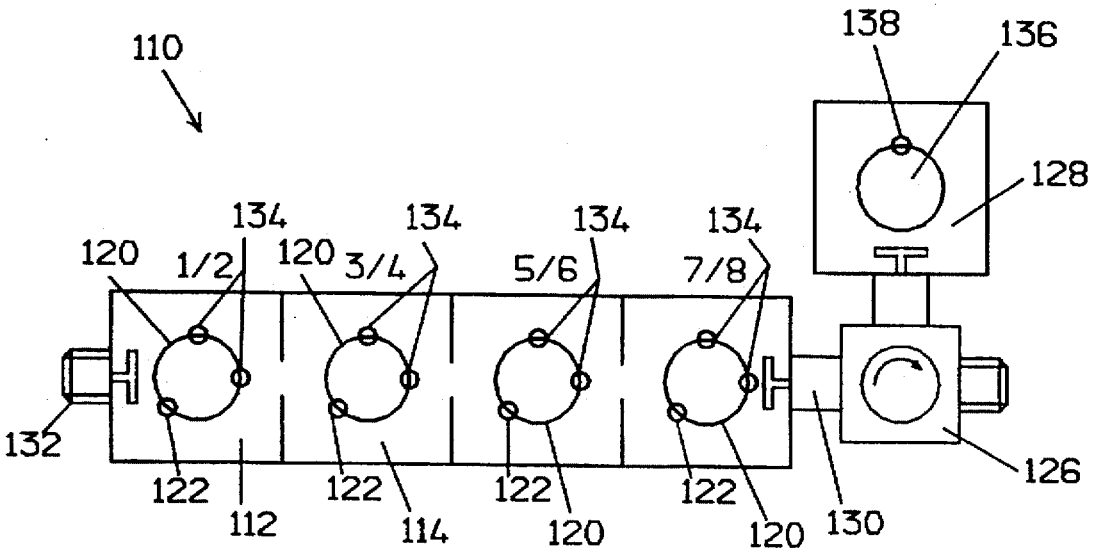
FIG. 9 is a dual-mode self-equalized filter having a dispersion equalization cavity.

In FIG. 9, an 8-pole dual-mode self-equalized filter 110 has four cavities 112, 114, 116, 118, each containing a single dielectric resonator disc 120. Each disc 120 supports two orthogonally-polarized $HEH_{11}$-mode electrical resonances. Self-equalization in a dual-mode filter is achieved by means of intra-cavity coupling screws 122 and inter-cavity coupling apertures 124. A circulator 126 and an equalizer cavity 128 are connected to a filter output 130. The filter 110 has an input 132. Tuning screws 134 are located as shown. The equalizer cavity 128 has a resonator 136 and coupling screw 138.

As can be determined from the description, the circulator and equalizer can be used on the filter outlet of various different types and sizes of filters. The equalizer and circulator can also be used with dual-mode or multi-mode filters. The cavities can contain dielectric resonators or the cavities of the filter can be without resonators.

In any waveguide transmission medium the group delay of a signal propagating in a length of the transmission line and the frequency of the signal are related by the formula:

$$\tau_g = \frac{L}{c\sqrt{1-(f_c/f)^2}}$$

Where:

$\tau_g$=group delay of the propagating signal

L=length of transmission line $f_c$=cut-off frequency of transmission medium $f$=frequency of propagating signal c=velocity of propagation of signal in dielectric of transmission medium (e.g. air, vacuum).

When $f=f_c$, $\tau_g=\infty$ and when $f\rightarrow\infty$, $\tau_g\rightarrow L/c$, the group delay of a distance L in free space. When $f_c=0$ (e.g. TEM or coaxial line) $\tau_g=L/C$ also.

This non-linear variation in group delay with frequency for a transmission line with a cut-off frequency > zero is known as dispersion. If a bandpass filter is constructed from coupled lengths of dispersing transmission line, a signal at the frequency of the lower edge of the filter's usable bandwidth (UBW) will have greater delay than a signal at the upper edge of the UBW. Thus the effect of dispersion is to superimpose a group delay slope onto the filter's own group delay characteristic. The nearer the UBW is to the cut-off frequency of the filter's resonant cavities, the greater the dispersion slope over the UBW will be. Filter resonators are normally designed to have cut-off frequencies as far below their UBW's as possible, to minimize the group delay slope over the UBW.

Further applicable equations are:

$$c\rightarrow c/\sqrt{\epsilon_r}$$

$$\lambda_g = \lambda\left[\epsilon_r - \left(\frac{\lambda}{\lambda_c}\right)^2\right]^{-1/2}$$

Where $\epsilon_r$ is the dielectric constant of a dielectric resonator $\lambda_g$ is the guided wavelength $\lambda$ is the wavelength in free space $\lambda_c$ is the wavelength of EM radiation propagating in free space at the cut-off frequency of the transmission medium.

The purpose of loading a waveguide resonant cavity with a dielectric disc is done mainly to reduce its size. The cut-off frequency of the cavity itself (Fcw2) is usually set to be above the UBW in order to provide a wide reject band before pure waveguide modes start to propagate. When the cavity is loaded with the dielectric disc, the cut-off frequency of the combination is reduced to be below the UBW (Fcd).

Physical constraints and wideband rejection and Q-factor considerations usually dictate that the frequency separation of Fcd and Fcw2 is relatively small, and are placed to be roughly equidistant below and above the UBW. This means that the UBW of the filter will be closer to the cut-off frequency Fcd than with the pure waveguide solution, and consequently that dispersive group delay slopes over the UBW will be higher. While the equalizer frequency will always be slightly higher than the centre frequency of the filter for waveguide and dielectrically loaded filters, for coaxial filters, the equalizer filter could be higher or lower but will probably be lower than the centre frequency of the filter.

What I claim as my invention is:

1. A microwave filter comprising at least one cavity with a dielectric resonator, said at least one cavity having at least one of self-equalizing probes and self-equalizing apertures therein, said filter having an input and an output operatively connected thereto, said output of said filter being connected to an input of a circulator, said circulator having an input/output and an output, said input/output of said circulator being connected to an equalizer, said equalizer containing a dielectric resonator, the resonator of said equalizer being different from the resonator of said filter to permit said equalizer to be tuned at a slighty different frequency from said filter, said equalizer and said at least one of said self-equalizing probes and self-equalizing apertures being capable of being operated to reduce a dispersive slope of said filter, thereby compensating for the group delay therein.

2. A filter as claimed in claim 1 wherein the dielectric resonator in the equalizer is connected in series with the filter output using the circulator.

3. A filter as claimed in claim 2 wherein the frequency of the equalizer is higher than the passband of the filter.

4. A filter as claimed in claim 3 wherein the filter resonates in the Ku-band.

5. A filter as claimed in claim 4 wherein an isolator is connected to the input of the filter.

6. A filter as claimed in claim 4 wherein self-equalization is obtained through cross-coupling.

7. A microwave filter as claimed in any one of claims 1, 2 or 3 wherein the filter, circulator and equalizer are formed in microstrip on a substrate.

8. A microwave filter, as claimed in any one of claims 1, 2 or 3 wherein the at least one cavity further comprises a plurality of cavities, each cavity containing a dielectric resonator.

9. A filter as claimed in any one of claims 1, 2 or 3 wherein the at least one cavity further comprises a plurality of cavities, said cavities being arranged in two rows immediately adjacent to one another, each cavity containing a dielectric resonator, with means to cross-couple at least two of the cavities.

10. A filter as claimed in any one of claims 1, 3 or 4 wherein the filter resonates in a dual mode.

11. A microwave filter as claimed in any one of claims 1, 3 or 4 wherein the filter resonates in a single mode.

12. A microwave filter comprising at least one resonant cavity, said filter having a waveguide and having an input and an output operatively connected thereto, said output of said filter being connected to an input of a circulator, said circulator having an input/output and an output, said input/output of said circulator being connected to an equalizer, said filter containing extracted pole cavities, said extracted pole cavities being located between the input and output of said filter, said extracted pole cavities creating transmission zeros within said filter, said equalizer having a different frequency than a frequency of said filter, thereby providing group delay dispersion compensation for the filter.

13. A microwave filter as claimed in claim 12 wherein said at least one resonant cavity further comprises a plurality of resonant cavities and two extracted pole cavities.

14. A microwave filter as claimed in claim 13 wherein the filter resonates in at least one mode.

15. A microwave filter as claimed in claim 13 wherein the plurality of resonant cavities further includes six cavities and there are means for cross-coupling between the second and fifth cavities.

16. A microwave filter as claimed in claim 12 wherein the at least one resonant cavity further comprises a plurality of resonant cavities, said cavities having at least one of self-equalizing probes and self-equalizing apertures.

17. A microwave filter comprising at least one resonant cavity, said filter having a waveguide having an input and an output operatively connected thereto, said output of said filter being connected to an input of a circulator, said circulator having an input/output and an output, said input/output of said circulator being connected to said output of said filter, said at least one resonant cavity of said filter containing a dielectric resonator, said circulator being connected to a dielectric resonator, the dielectric resonator of said circulator being slightly different than the dielectric resonator of said at least one resonant cavity, thereby providing group delay dispersion compensation for the filter.

18. A method of reducing a dispersive slope of an output of a microwave filter, said filter having at least one cavity with a dielectric resonator in said at least one cavity, said filter having at least one of self-equalizing probes and apertures therein, said filter having an input and an output operatively connected thereto, said output being connected to an input of a circulator, said circulator having an output and an input/output, said input/output of said circulator being connected to an equalizer, said equalizer containing a dielectric resonator, said method comprising tuning said filter to a particular frequency, carrying out cross-coupling to self-equalize said filter, tuning said filter to reduce a dispersive slope of an output of said filter, thereby compensating for the group delay therein.

19. A method as claimed in claim 18 wherein the dielectric resonator in said at least one cavity of the filter is different from the dielectric resonator of said equalizer, said method including the steps of tuning said filter and said equalizer to slightly different frequencies because of the difference in said dielectric resonators.

20. A method as claimed in any one of claims 18 or 19 including the step of operating said filter in a single mode.

21. A method as claimed in any one of claims 18 or 19 including the step of operating said filter in a dual mode.

22. A method as claimed in claim 18 including the step of tuning said equalizer to a higher frequency than a frequency of said filter.

23. A method as claimed in claim 18 including the step of adjusting an amplitude slope of the equalizer by introducing a lossy element within a cavity of the equalizer to compensate for an amplitude slope of the filter.

24. A method as claimed in claim 23 including the step of introducing an unplated steel screw as the lossy element.

25. A method of reducing a dispersive slope of an output of a microwave filter, said filter having a waveguide and having at least one resonant cavity, said filter having an input and output operatively connected thereto, said output of said filter being connected to an input of a circulator, said circulator having an output and an input/output, said input/output of said circulator being connected to an equalizer, said filter having a plurality of extracted pole cavities being connected to said waveguide and being located between the input and output of said filter, said method comprising tuning said filter to a slightly different frequency from a frequency of said equalizer, creating transmission zeros in said filter using said extracted pole cavities, thereby providing group delay dispersion compensation for the filter.

26. A method of reducing a dispersive slope of an output of a microwave filter, said filter having at least one cavity, said filter having at least one of self-equalizing probes and apertures therein, said filter having an input and output operatively connected thereto, said output being connected to an input of a circulator, said circulator having an output and an input/output, said input/output of said circulator being connected to an equalizer, at least one of said filter and said equalizer having a tuning screw in a wall thereof, said method comprising tuning the equalizer and filter to different frequencies by varying the depth of said tuning screw, thereby providing group delay dispersion compensation for the filter.

27. A method claimed in claim 26 wherein the at least one cavity further comprises more than one cavity and there are tuning screws for each cavity of the filter and for the equalizer, said method including the steps of tuning said filter and said equalizer to different frequencies by varying the depth of said tuning screws.

* * * * *